US006790528B2

(12) United States Patent
Wendorff et al.

(10) Patent No.: US 6,790,528 B2
(45) Date of Patent: Sep. 14, 2004

(54) PRODUCTION OF POLYMER FIBRES HAVING NANOSCALE MORPHOLOGIES

(75) Inventors: Joachim H. Wendorff, Muenster (DE); Martin Steinhart, Marburg (DE)

(73) Assignee: TransMIT Gesellschaft fuer Technologietransfer mbH, Giessen (DE)

( * ) Notice: Subject to any disclaimer, the term of this patent is extended or adjusted under 35 U.S.C. 154(b) by 0 days.

(21) Appl. No.: 10/344,419

(22) PCT Filed: Aug. 10, 2001

(86) PCT No.: PCT/EP01/09236

§ 371 (c)(1),
(2), (4) Date: Jul. 3, 2003

(87) PCT Pub. No.: WO02/16680

PCT Pub. Date: Feb. 28, 2002

(65) Prior Publication Data

US 2004/0013873 A1 Jan. 22, 2004

(30) Foreign Application Priority Data

Aug. 18, 2000 (DE) ..... 100 40 897

(51) Int. Cl.[7] ..... D01F 6/00; D02G 3/00
(52) U.S. Cl. ..... 428/376; 428/398
(58) Field of Search ..... 428/398, 376; 264/10, 41, 49, 413

(56) References Cited

U.S. PATENT DOCUMENTS 4,992,332 A * 2/1991 Kamei et al. ..... 428/398
5,344,711 A * 9/1994 Kanzaki et al. ..... 428/398
6,667,099 B1 * 12/2003 Greiner et al. ..... 428/398
6,689,374 B2 * 2/2004 Chu et al. ..... 424/423

FOREIGN PATENT DOCUMENTS

| | | |
|---|---|---|
| DE | 20 32 072 | 1/1972 |
| DE | 25 34 935 | 2/1976 |
| WO | 01 09414 | 2/2001 |

OTHER PUBLICATIONS

J. Doshi et al.: "Electrospinning process and applications of electrospun fibers"Journal of Electrostatics, vol. 35, No. 2, pp. 151–160, Aug. 1, 1995.

* cited by examiner

*Primary Examiner*—N. Edwrads
(74) *Attorney, Agent, or Firm*—Oblon, Spivak, McClelland, Maier & Neustadt, P.C.

(57) ABSTRACT

The invention relates to porous fiber comprising a polymeric material, said fiber having a diameter of 20 to 4000 nm and pores in the form of channels extending at least to the core of said fiber and/or through said fiber.

Figure 1:
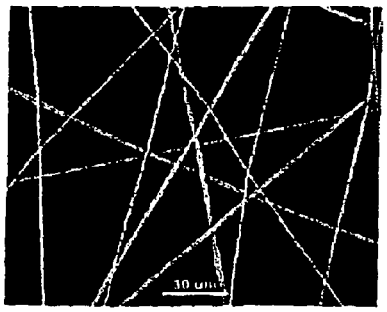

The process for producing the porous fiber comprises electrospinning a 5 to 20% by weight solution of at least one polymer in an organic solvent using an electric field above $10^5$ V/m to obtain a fiber having a diameter of 20 to 4000 nm and pores in the form of channels extending at least to the core of said fiber and/or through said fiber.

The porous fiber may be used as a carrier for a catalyst, as an adsorbent or absorbent or as a biomaterial, may be chemically modified or functionalized or may be used as a template for producing highly porous solids.

16 Claims, 1 Drawing Sheet

Illustrations of porous as-spun fibers (SE micrographs):

PRODUCTION OF POLYMER FIBRES HAVING NANOSCALE MORPHOLOGIES

This invention relates to a process for producing nanoscale polymeric fibers having morphologies and textures, especially having open porous structures, and also their modification and use.

Owing to their high surface/volume ratio and their differences to typical ordering structures in macroscopic systems, nanoscale materials have special physical and chemical properties, described for example in Gleitner, H.; "Nanostructured Materials", in *Encyclopedia of Physical Science and Technology*, Vol. 10, p. 561 ff. These include short-range magnetic properties in the case of metallic or oxidic materials, easy field-induced tunneling of electrons from filament tips, or particularly advantageous biocompatibilities due to nanoscale microdomains. These differences in property profiles compared with macroscopic materials have led to technological innovations in microelectronics, display technology, surface technology, catalyst manufacture and medical technology, especially as carrier materials for cell and tissue cultures.

Fiber materials having filament diameters of less than 300 nm, in fact down to a few 10 nm, are useful, if electroconductive, as field electron emission electrodes according to WO 98/1588. They similarly offer technological benefits in semiconductor systems as described in U.S. Pat. No. 5,627,140 and also as catalyst systems having improved activity profiles, described in WO 98/26871. Such fibers can be chemically modified and be provided with chemical functions, for example by chemical etching or by plasma treatment, processed into woven fabrics or compacted into feltlike materials. They can be incorporated, not only in unorganized form but also in an aligned or organized form as wovens, drawn-loop knits, formed-loop knits or in some other compacted arrangement, into macroscopic construction material systems in order that mechanical or other physical properties of the materials of construction may be improved.

According to WO 00/22207, fibers having diameters of less than 3000 nm can be produced using compressed gases expanding from specific nozzles. Prior art also includes electrostatic spinning processes described in DE 100 23 456.9. GB 2 142 870, for example, describes an electrostatic spinning process for manufacturing vascular grafts.

Nanofibers can be used as templates for coatings applied to the fibers from solutions or by vapor deposition for example. This makes it possible to deposit on the fibers not only polymeric, ceramic, or oxidic or glassy materials but also metallic materials in the form of uninterrupted layers. By dissolving, vaporizing, melting or pyrolyzing the inner, polymeric template fiber it is thus possible to obtain tubes in a wide variety of materials of construction whose inner diameter can be varied from 10 nm up to a few $\mu$m, depending on the filament diameter, and whose wall thicknesses are in the nm or $\mu$m range, depending on coating conditions. The production of such nano- or mesotubes is described in DE 10 23 456.9.

For certain applications of nanoscale fibers it appears to be advantageous to create a large surface area using porous materials. In WO 97/43473, fibers are provided with a porous coating. A subsequent pyrolysis treatment provides high-porosity fibers that are advantageous for catalytic uses for example.

The above-described processes for producing porous nano- and mesoscale fibers require plural steps and are time and cost intensive. Furthermore, porous fiber materials offer additional technical benefits over uninterrupted, solid fibers, since they have a substantially larger surface area. True, nanotubes have a very large surface area, but are very inconvenient to produce because of the pyrolysis step.

EP 0 047 795 describes polymeric fibers having a solid core and a porous, foamy sheath surrounding the core. The fiber core is said to possess high mechanical stability, while the porous sheath has a large surface area. Yet in the case of very surface-active applications, for example filtrations, the porous structure created according to EP 0 047 795 is frequently inadequate.

It is an object of the present invention to provide nano- and mesoscale polymeric fibers having a very large surface area using a simple process.

This object is achieved by porous fiber comprising a polymeric material, the fiber having a diameter of 20 to 4000 nm and pores in the form of channels extending at least to the core of the fiber and/or through the fiber.

The invention further provides a process for producing porous fiber from a polymeric material, which comprises electrospinning a 3 to 20% by weight solution of a polymer in a volatile organic solvent or solvent mixture using an electric field above $10^5$ V/m to obtain a fiber having a diameter of 20 to 4000 nm and pores in the form of channels extending at least to the core of the fiber and/or through the fiber.

Electrospinning processes are described for example in Fong, H.; Reneker, D. H.; *J. Polym. Sci.*, Part B, 37 (1999), 3488, and in DE 100 23 456.9.

Field strengths vary from 20 to 50 kV, preferably from 30 to 50 kV, and linear spinning speeds (exit speed at spinneret) from 5 to 20 m/s, preferably from 0.8 to 15 m/s.

Porous fiber structures according to the invention comprise polymer blends or copolymers, preferably polymers such as polyethylene, polypropylene, polystyrene, polysulfone, polylactides, polycarbonate, polyvinylcarbazole, polyurethanes, polymethacrylates, PVC, polyamides, polyacrylates, polyvinylpyrrolidones, polyethylene oxide, polypropylene oxide, polysaccharides and/or soluble cellulose polymers, for example cellulose acetate.

These polymers may be used individually or in the form of their blends. In a particular embodiment of the invention, said polymeric material comprises at least one water-soluble polymer and at least one water-insoluble polymer.

A blend of water-soluble and water-insoluble polymers may have a blending ratio in the range from 1:5 to 5:1 and preferably equal to 1:1.

In processes according to the invention, 3–20% by weight, preferably 3–10% by weight, particularly preferably 3–6% by weight, of at least one polymer are dissolved in an organic solvent and electrospun into a porous fiber. The fibers of the invention have diameters from 20 to 1500 nm, preferably 20 to 1000, particularly preferably 20 to 500, most preferably 20 to 100, nm.

The volatile organic solvent used may be dimethyl ether, dichloromethane, chloroform, ethylene glycol dimethyl ether, ethylglycol isopropyl ether, ethyl acetate or acetone or a mixture thereof with or without further solvents. The vaporizing step may be carried out at atmospheric pressure or else under reduced pressure. If necessary, the pressure shall be adapted to the boiling points of the solvents.

It is advantageous to use solvents or solvent mixtures in the process which are a theta solvent for the polymer/polymer blend in question. The polymer solutions may also pass through the theta state during the electrospinning process. This is the case for example during the vaporizing of the solvent.

For polymer solutions in the theta state see Elias, H. G., in Polymer Handbook, IIIrd Ed., John Wiley & Sons, 1989; section VII.

These solutions are spun by electrospinning. Typically a polymer solution is continually pumped into spinnerets or, in the lab, into a spray cannula whose diameter is not more than 0.5 mm in the case of the apparatus available. The field strengths between cannula and counterelectrode may be $2\times10^5$ V/m and the distance may reach 200 mm. This produced uniform fibers having diameters from 20 to 4000 nm, as can be seen in the scanning electron micrograph of FIG. 1. Instabilities may also lead to irregular thick places on the as-spun filaments. The surprising regular morphology, which is characterized by open pores, becomes apparent in the enlargements of FIGS. 2 to 5. The production of the porous polymeric nano- and mesofilaments is illustrated in the examples.

The porous fibers of the invention have a large surface area of above 100 $m^2/g$, preferably above 300 $m^2/g$, especially above 600 $m^2/g$, and most preferably above 700 $m^2/g$. These surface areas can be calculated from dimensions derived from scanning electron micrographs or measured by the BET nitrogen adsorption method.

The porous fibers produced by the process of the invention can be processed into wovens, drawn-loop knits and shaped and also structured pressed stock; wet-chemically and plasma-chemically modified; or loaded with materials having different objectives, for example pharmaceutically active entities or catalytic precursors, by impregnating and subsequent drying.

The porous fibers of the invention may further be used as ad- or absorbents, in the biological sector (biomaterial) and also as templates for producing highly porous solid articles (for example ceramics by casting and burning out the polymeric templates).

The porous fibers of the invention may further be subjected to surface modification using a low temperature plasma or chemical reagents, for example aqueous sodium hydroxide solution, inorganic acids, acyl anhydrides or halides or else, depending on the surface functionality, with silanes, isocyanates, organic acyl halides or anhydrides, alcohols, aldehydes or alkylating chemicals including the corresponding catalysts. Surface modification may be used to confer on the porous fibers a more hydrophilic or hydrophobic surface, and this is advantageous for use in the biological or biomedical sector.

Porous fibers according to the invention can be used as reinforcing composite components in polymeric materials of construction, as filter materials, as carriers for catalysts, for example as a hydrogenation catalyst after coating of the pores with nickel, or for pharmaceutically active agents, as a scaffolding material for cell and tissue cultures and for a wide variety of implants where, for example, osseointegration or vascularization are used structurally. Epithelium cells are thereby readily cultivable on porous polystyrene fibers. It is similarly possible to apply osteoblasts to porous polylactide carriers and to grow a cell tissue by differentiation.

A further surprising effect is the anisotropy of the porous fibers according to the invention, which is identifiable by their birefringence. They are therefore particularly useful as a reinforcing component in fiber composites, where the large internal surface area provides effective bonding and strength for the polymer matrix, especially after suitable surface modification.

In another embodiment of the invention, ternary mixtures of two polymers, of which one is water soluble, for example polyvinylpyrrolidone, polyethylene oxide, polypropylene oxide, polysaccharides or methylcellulose, and a volatile solvent or solvent mixture is spun. These ternary solutions were electrostatically spun in the same manner as the binary mixtures recited above. Nano- and mesofibers were formed, but they did not possess porous morphology. A nonporous structure is obtained for the fiber when conventional electrospinning processes are used. It is advantageous in conventional electrospinning processes to use polymer solvents that are remote from the theta state and do not pass through it during the spinning process.

Figure 6:
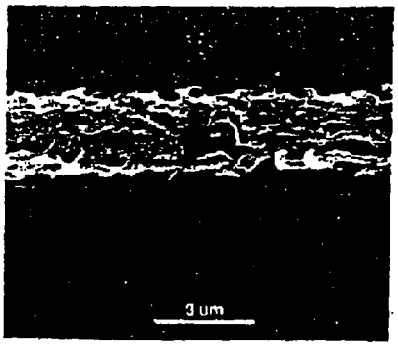

Only after a water treatment at elevated temperatures, which led to the water-soluble polymer component being dissolved out, did the fiber materials exhibit a porous morphology comprising channel pores extending at least to the fiber core and/or through the fiber; see scanning electron micrographs in FIG. 6.

This fiber material too can be processed into wovens, drawn-loop knits and formed and also structured pressed articles; surficially modified and also functionalized; and be directed to the hereinabove recited uses.

The examples which follow illustrate the production of ultrathin, cylindrical porous fibers according to the invention.

PRODUCTION EXAMPLE 1

Partly crystalline poly-L-lactide (PLLA) having a glass transition temperature of 63° C., a melting temperature of 181° C. and an average molecular weight of 148,000 g/mol (manufacturer: Böhringer Ingelheim, Germany) was dissolved in dichloromethane (FLUKA, Germany; chromatography grade). The concentration of the polymer in the solution was 4.4% by weight.

The metering rate of the solution to the outlet cannula, which had an internal diameter of 0.5 mm, was varied between 0.3 and 2 $cm^3/s$. The temperature of the solution had been set to 25° C.

The distance between cannula tip and counterelectrode was between 10 and 20 cm, while the operating voltage had been set to 35 kV.

Figure 2:
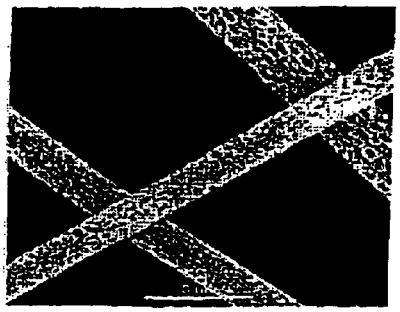

The spinning process produced porous fibers having diameters from 100 nm to 4 $\mu$m, depending on the metering rate. Scanning electron micrographs (recorded on CamScan 4) show uniformly shaped fibers, as depicted in FIG. 1, which reveal the continuous, open porous structure at higher REM resolution (FIG. 2). Not only the ellipsoidal pore openings, which are oriented in the spinning direction and have sizes from 100 to 400 nm in the direction of the fiber axes and from 20 to 200 nm in the transverse direction, but also examination of the fibers under a polarizing microscope (Zeiss MBO 50 including a rotatable polarizer) indicate appreciable anisotropy on the part of the porous fiber materials produced in this way.

The BET surface areas of these porous fibers were between 200 and 800 $m^2/g$; calculation of the surface area from the scanning electron micrographs even revealed surface areas of up to 1500 $m^2/g$.

Figure 3:
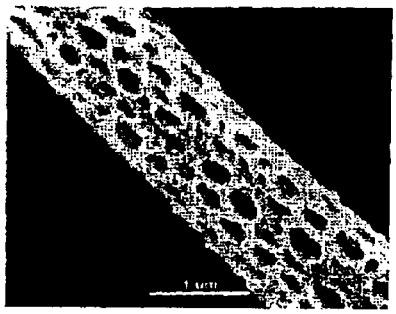

The scanning electron micrograph of FIG. 3 illustrates a porous PLLA fiber produced at a metering rate of 0.8 $cm^3/s$ for the solution. The BET surface area of this fiber was measured at 650 $m^2/g$, while the value calculated from the scanning electron micrograph was 1200 $m^2/g$.

PRODUCTION EXAMPLE 2

An aromatic polyurethane (Tecoflex™ from Thermetics, USA) having an average molar mass of 180,000 g/mol was dissolved in acetone (FLUKA, Germany; chromatography grade) in a concentration of 6% by weight. The temperature of the solution had been adjusted to 23° C.

The electrostatic spinning conditions were the same as those of production example 1. The anisotropic porous filaments which were again obtained had diameters ranging from 120 nm to 4 μm and a BET surface area between 150 and 600 $m^2/g$.

Figure 4:
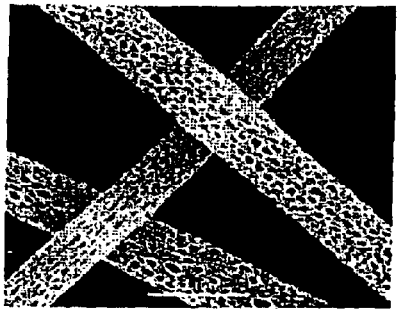

The scanning electron micrograph of FIG. 4 illustrates such polyurethane filaments which were obtained at a metering rate of 1.2 $cm^3/s$ (BET: 490 $m^2/g$)

PRODUCTION EXAMPLE 3

A 13% by weight solution of polycarbonate having an average molecular weight of 230,000 g/mol in dichloromethane as per production example 1 was electrostatically spun at a feed temperature of 20° C. and a metering rate of 1.5 $cm^3/s$. The electric field strength was 30 kV/m.

Figure 5:
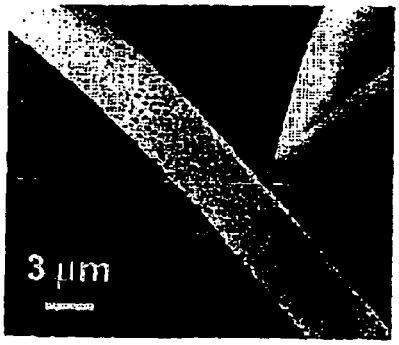

FIG. 5 illustrates a thus produced fiber, whose pores are characterized by distinctly smaller diameters. The fiber porosity was 250 $m^2/g$. On the basis of calculations, performed using pore and filament dimensions taken from the scanning electron micrograph it has to be assumed that pores extend at least into the filament core.

The same process according to the invention was used to process a solution of 7.5% by weight of polyvinylcarbazole in dichloromethane into filaments under the same conditions. The results were similar to those of polycarbonate spinning.

The production example which follows illustrates the production of ultrathin porous fibers from blends of water-insoluble and water-soluble polymers.

PRODUCTION EXAMPLE 4

Atactic amorphous poly-D,L-lactide (PDLLA) having an average molecular weight of 54,000 g/mol and a glass transition temperature of 52° C. (manufacturer: Böhringer Ingelheim, Germany) and polyvinylpyrrolidone having an average molecular weight of 360,000 g/mol (K90; FLUKA, Germany) were dissolved in dichloromethane in weight ratios of 5:1, 1:1 and 1:5. The polymer blend concentrations in dichloromethane were between 2 and 5% by weight.

The electrode separation was 23 cm and the operating voltage 40 kV. The metering rates range from 0.5 to 2 $cm^3/s$.

Filaments were obtained with diameters from 80 nm to 4 μm that did not show any porosity whatever in a scanning electron micrograph.

The water-soluble polyvinylpyrrolidone (PVP) can be completely dissolved out of the thus produced fibers or out of webs fabricated therefrom, by treatment with water below room temperature. PVP removal was complete after just 15 minutes of ultrasonication.

FIG. 6 shows by way of example the scanning electron micrograph of a porous fiber produced in this way from a mixture of 5:1 PVP:PDLLA, whose BET surface area was measured at 315 $m^2/g$.

The PVP/PDLLA ratios of 1:1 and 1:5 produced in that order decreasing porosities with BET surface areas of 210 $m^2/g$ and 170 $m^2/g$.

The porous filaments produced according to the invention are depositable as random coils. Given a suitable geometry for the counterelectrode, sheetlike or ribbony arrangements of the as-spun fibers are producible as well.

USE EXAMPLE 1

Coiled porous fibers as spun in production example 1 were uniformly packed into a cylindrical aluminum mold having a diameter of 20 mm and a rim height of again 20 mm and compressed by hand to a depth of 5 mm. The compressed porous fibers were then compacted with a matching aluminum ram being applied with a compressive force of 30 kp at 50° C. for a period of 15 minutes.

This produced flat round pressed articles from 200 to 600 μm in thickness, whose BET surface areas were not more than 15% below the BET surface areas of the fibers used.

The porous fiber produced in production example 1 at a metering rate of 0.8 $cm^3/s$ was similarly compressed in plural stages and compacted in the last phase using a force of 60 kp being provided at 50° C. for 60 minutes. This produced a pressed article 1.2 mm in thickness having a BET surface area of 380 $m^2/g$.

The wettability of the pressed articles with water was average, the contact angle being between 45 and 58 degrees.

The plaque thus produced was used as an ad- and absorbent in a laboratory suction filter having a tight closure between the funnel and the glass frit underneath. When 100 ml of a 0.1% sugar solution was applied and passed through just once, the sugar was completely retained by the sorbent layer produced from the porous fibers of the invention.

USE EXAMPLE 2

The coiled porous fibers produced as per production example 2 were activated in a microwave plasma by the action of an argon/oxygen mixture.

The apparatus used, Hexagon, was obtained from Technics Plasma, Germany. The microwave power had been set to 300 W, the system pressure was 0.02 bar, and the two gases each were continuously added by defined leak at a rate of $4\times10^{-3}$ standard liter/min. The porous filaments had been placed in the plasma apparatus in a horizontal, cylindrical rotary glass drum which was open at one end and was turning at n=20 revolutions/minute.

After plasma treatment, the activated porous filaments were stirred into an aqueous solution of 5% by weight of hydroxyethyl methacrylate (from Röhm, Germany), filtered off after a exposure time of 15 minutes and dried at 50° C. under a water jet vacuum for 24 hours.

The fibers treated in the manner described above were subsequently treated with UV rays while being repeatedly turned. The UV source used was an arrangement of 4 Ultra-Vitalux lamps (from Osram, Germany). They were irradiated for 30 minutes at an average distance of 20 cm from the source.

The fibers were subsequently washed in water and filtered. The filtrate was found not to contain any free hydroxyethyl methacrylate (detection limit: 200 ppm in water), so that virtually complete chemical attachment of the hydroxyethyl methacrylate to the surface of the porous fibers can be assumed.

The pressed articles produced therefrom as per use example 1 had a BET surface area of 680 $m^2/g$ and were characterized by very good wettability with water.

The pressed articles obtained from use examples 1 and 2 were examined for their characteristics with regard to living cells in collaboration with the Institute for Physiological Chemistry in the University of Münster in Germany. To this end, the samples were inoculated with human umbilical vein endothelial cells (HUVECs) and subsequently examined for growth.

While the samples of use example 1, on application in 24 microwell plates (Nunc, Denmark) for 5 days (37° C., 37% by volume of $CO_2$ in the sterile room air), subsequently exhibited a HUVEC number of 22,000 to 30,000 per cavity, samples of the compression moldings as per use example 2 produced endothelial cell numbers of 45,000 to 60,000 per cavity under the same conditions.

It was further determined that, in the case of samples of use example 2, neither any DNA activation nor mRNA synthesis nor expression of cell-typical proteins is reduced, altered or degenerated. The method described in use example 2 is suitable for converting porous fibers produced according to the invention into cell- and tissue-compatible biomaterials.

USE EXAMPLE 3

Fiber materials of production examples 2 and 3 were twisted and compacted into yarns in a manner resembling the classic spinning process, for which the fibers were slightly moistened. The yarn material obtained had a thickness of 0.3 to 0.4 mm and resembled wool fiber. After drying, the yarns expanded to a thickness of 0.6 to 1 mm.

This yarn material from the porous primary fibers of the invention can be wound into bobbins and was processible into simple woven fabric in the lab.

The use of adhesives, binders and strengthening crosslinkers for surface-activated fibers (use example 2) improves not only the processibility of the fiber materials obtained from the primary fiber of the invention but also their tensile strength.

The fabrics produced in this way are particularly useful for producing highly porous catalyst carriers, thermal insulating materials, absorbers and filters, as a scaffolding material in tissue engineering and for blood vessel and bone implantology. The high porosities promote vascularization, augment not only the cell supply with nutrients but also the disposal of metabolites and offer advantages with regard to cell differentiation and also osseofication and tissue integration.

USE EXAMPLE 4

Fibers as per production examples 1 and 3 were exposed to an argon atmosphere containing nickel carbonyl (FLUKA) in a plasma apparatus (from Eltro, Baesweiler, Germany) in a rotating glass drum as per use example 2 at a pressure of 15 Pa, a 2.45 GHz microwave power of 2 kW, a pulse duration of 500 $\mu$s and a period of 2 s. The argon flowed at 5 l/h over nickel tetracarbonyl heated to 40° C. The feed lines to the plasma chamber were temperature controlled at 100° C. to prevent deposits of $Ni(CO)_4$.

Following a treatment time of just 10 minutes the filaments had become completely blackened by deposition of very fine metallic nickel.

The porous filaments thus treated were pressed into plaques 1 mm in thickness as per use example 1 and cut into 5 mm×5 mm squares. These were subsequently supplementarily reduced with hydrogen in a temperature controlled glass tube at 50° C. for 3 hours. The hydrogen flow rate was 10 l/h.

Ethylene was then mixed in at the same temperature at a flow rate of 1 l/h and became completely hydrogenated to ethane.

What is claimed is:

1. Porous fiber comprising a polymeric material, said fiber having a diameter of 20 to 4000 nm and pores in the form of channels extending at least to the core of said fiber and/or through said fiber.

2. The porous fiber of claim 1 having a surface area of above 100 $m^2g$.

3. The porous fiber of claim 1 wherein said polymeric material is a homopolymer, a copolymer or a polymer blend.

4. The porous fiber of claim 1, wherein said polymeric material is selected from the group consisting of polyethylene, polypropylene, polystyrene, polysulfone, polylactides, polycarbonate, polyvinylcarbazole, polyurethanes, polymethacrylates, PVC, polyamides, polyacrylates, polyvinylpyrrolidones, polyethylene oxide, polypropylene oxide, polysaccharides and soluble cellulose polymers.

5. The porous fiber of claim 1, wherein said polymeric material comprises at least one water-soluble polymer and at least one water-insoluble polymer.

6. The porous fiber of claim 1 subjected to a surface modification using a low temperature plasma or a chemical reagent.

7. A process for producing porous fiber from a polymeric material, which comprises electrospinning a 5 to 20% by weight solution of at least one polymer in a volatile organic solvent or solvent mixture using an electric field above $10^5$ V/m to obtain a fiber having a diameter of 20 to 4000 nm and pores in the form of channels extending at least to the core of said fiber and/or through said fiber.

8. The process of claim 7 wherein one or more water-soluble polymers and one or more water-insoluble polymers are used.

9. The process of claim 7 wherein said organic solvent or solvent mixture is a theta solvent for said polymeric material.

10. The process of claim 7 wherein said solution of said at least one polymer is in a theta state or passes through a theta state during said electrospinning.

11. The process of claim 7 wherein said porous fiber is subjected to a surface modification using a low temperature plasma or a chemical reagent.

12. In a carrier for a pharmaceutically active agent, the improvement comprising using the porous fiber of claim 1 as the carrier.

13. In a carrier for a catalyst, the improvement comprising using the porous fiber of claim 1 as the carrier.

14. In a reinforcing composite component in a polymeric material of construction, the improvement comprising using the porous fiber of claim 1 as the reinforcing composite component.

15. In an adsorbent or absorbent, the improvement comprising using the porous fiber of claim 1 as the adsorbent or absorbent.

16. In a scaffolding material for a cell or tissue culture, the improvement comprising using the porous fiber of claim 1 as the scaffolding material.

* * * * *

UNITED STATES PATENT AND TRADEMARK OFFICE

CERTIFICATE OF CORRECTION

PATENT NO. : 6,790,528 B2
DATED : September 14, 2004
INVENTOR(S) : Wendorff et al.

It is certified that error appears in the above-identified patent and that said Letters Patent is hereby corrected as shown below:

Title page,
Item [75], Inventors, should read:

-- Joachim H. Wendorff, Marburg (DE);
Martin Steinhart, Marburg (DE);
Johannes Averdung, Gelsenkirchen (DE);
Lothar Heinrich, Muenster (DE) --

Signed and Sealed this

Fourteenth Day of December, 2004

JON W. DUDAS
*Director of the United States Patent and Trademark Office*